US009053883B2

(12) United States Patent
Yamashita et al.

(10) Patent No.: US 9,053,883 B2
(45) Date of Patent: Jun. 9, 2015

(54) GAS CIRCUIT BREAKER

(75) Inventors: Toru Yamashita, Tokyo (JP); Daisuke Yoshida, Tokyo (JP); Katsuhiko Horinouchi, Tokyo (JP); Manabu Kawakami, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 154 days.

(21) Appl. No.: 13/819,848

(22) PCT Filed: Oct. 12, 2010

(86) PCT No.: PCT/JP2010/067874

§ 371 (c)(1),
(2), (4) Date: Feb. 28, 2013

(87) PCT Pub. No.: WO2012/049730

PCT Pub. Date: Apr. 19, 2012

(65) Prior Publication Data

US 2013/0161288 A1 Jun. 27, 2013

(51) Int. Cl.

*H01H 33/90* (2006.01)
*H01H 33/70* (2006.01)
*H01H 33/88* (2006.01)

(52) U.S. Cl.

CPC ..... *H01H 33/901* (2013.01); *H01H 33/7092* (2013.01); *H01H 2033/902* (2013.01)

(58) Field of Classification Search

CPC ... H01H 33/91; H01H 33/7092; H01H 33/88; H01H 33/885; H01H 33/884; H01H 33/886; H01H 33/90
USPC ..... 218/47, 57, 60
See application file for complete search history.

(56) References Cited

U.S. PATENT DOCUMENTS 6,429,394 B2 * 8/2002 Hunger et al. ..... 218/155

FOREIGN PATENT DOCUMENTS

| | | | |
|---|---|---|---|
| JP | 2-100218 | A | 4/1990 |
| JP | 2004-55162 | A | 2/2004 |
| JP | 2008-112633 | A | 5/2008 |
| JP | 2009-59541 | A | 3/2009 |
| JP | 2010-100893 | A | 5/2010 |

OTHER PUBLICATIONS

Machine translation of foreign document (JP 2009-059541 A) Mar. 19, 2009.*
International Search Report (PCT/ISA/210) issued on Nov. 9, 2010, by the Japanese Patent Office as the International Searching Authority for International Application No. PCT/JP2010/067874.
Written Opinion (PCT/ISA/237) issued on Nov. 9, 2010, by the Japanese Patent Office as the International Searching Authority for International Application No. PCT/JP2010/067874.
Office Action for Japanese Application No. 2011-504074, dated Feb. 8, 2013, and English Translation.

* cited by examiner

*Primary Examiner* — Renee Luebke
*Assistant Examiner* — William Bolton
(74) *Attorney, Agent, or Firm* — Buchanan Ingersoll & Rooney PC

(57) ABSTRACT

A gas circuit breaker includes: a sealed tank filled with insulation gas; a pair of arc contacts that are arranged to face each other in the sealed tank and connectable and disconnectable with each other; a thermal puffer chamber that is provided on an outer circumferential portion of the pair of arc contacts; a mechanical puffer chamber that is provided on an outer circumference of the thermal puffer chamber and constituted by a cylinder formed in a toric shape centering around an axial line of the arc contacts; and a piston that is formed in a toric shape centering around the axial line and accommodated in the cylinder, and configured to move according to connection and disconnection of the arc contacts.

5 Claims, 3 Drawing Sheets

GAS CIRCUIT BREAKER

FIELD

The present invention relates to a puffer-type gas circuit breaker that is installed in an electric station such as an electric substation or switching station, and extinguishes an arc generated between contacts by discharging of insulation gas.

BACKGROUND

As this type of gas circuit breaker, for example, Patent Literature 1 discloses a gas circuit breaker including, in a container filled with insulation gas, a thermal puffer chamber provided on an outer circumference of a movable side contact among arc contacts (hereinafter, also referred to as "movable arc contact") and a mechanical puffer chamber provided adjacent to the thermal puffer chamber in an axial direction.

This gas circuit breaker is configured such that insulation gas is heated and pressurized by arc energy and accumulated in the thermal puffer chamber at the time of current cutoff, and high-pressure insulation gas is discharged to an arc to cut the current off at around a current zero point, while the high-pressure insulation gas in the mechanical puffer chamber is discharged to an arc generation area by way of the thermal puffer chamber to recover insulation performance of the gas circuit breaker.

Furthermore, Patent Literature 2 discloses a gas circuit breaker including, in a container filled with insulation gas, a thermal puffer chamber provided on an outer circumference of a movable side contact among arc contacts (hereinafter, also referred to as "movable arc contact") and a plurality of mechanical puffer chambers having a cylindrical shape which are provided on an outer circumference of the thermal puffer chamber.

CITATION LIST

Patent Literatures

Patent Literature 1: Japanese Patent Application Laid-open No. 2004-055162

Patent Literature 2: Japanese Patent Application Laid-open No. 2009-059541

SUMMARY

Technical Problem

However, in the gas circuit breaker disclosed in

Patent Literature 1, because the thermal puffer and the mechanical puffer are arranged in series in the axial direction, there has been a problem that the length of an arc extinguishing chamber in the axial direction is adversely increased.

Furthermore, in the gas circuit breaker disclosed in Patent Literature 2, although the length of the extinguishing chamber in an axial direction is short because the mechanical puffers are arranged on the outer circumference of the thermal puffer, there has been a problem that volume efficiency is degraded because the plural mechanical puffers are formed in a cylindrical shape so that the whole size adversely becomes larger in a radial direction.

The present invention has been achieved in view of the above circumstances, and an object of the present invention is to provide a gas circuit breaker that can be downsized by enhancing efficiency in arranging a mechanical puffer chamber and a thermal puffer chamber.

Solution to Problem

In order to solve the above-mentioned problems and achieve the object, the present invention provides a gas circuit breaker comprising: a sealed tank filled with insulation gas; a pair of arc contacts that are arranged to face each other in the sealed tank and connectable and disconnectable with each other; a thermal puffer chamber that is provided on an outer circumferential portion of the pair of arc contacts; a mechanical puffer chamber that is provided on an outer circumference of the thermal puffer chamber and constituted by a cylinder formed in a toric shape centering around an axial line of the arc contacts; and a piston that is formed in a toric shape centering around the axial line and accommodated in the cylinder, and configured to move according to connection and disconnection of the arc contacts.

Advantageous Effects of Invention

According to the present invention, by forming a mechanical puffer in a toric shape and disposing it on an outer circumference of a thermal puffer, the length of the gas circuit breaker is shortened in an axial direction by the length of the mechanical puffer as compared to the case of arranging the thermal puffer and the mechanical puffer in series in the axial direction, and the gas circuit breaker can be downsized as the diameter of an outermost portion of the mechanical puffer is shortened as compared to the case of arranging a plurality of mechanical puffers having a cylindrical shape on the outer circumference of the thermal puffer.

DESCRIPTION OF EMBODIMENTS

Now gas circuit breakers according to embodiments of the present invention will be explained below in detail with reference to the drawings. The present invention is not limited to the embodiments.

First Embodiment

Figure 1:
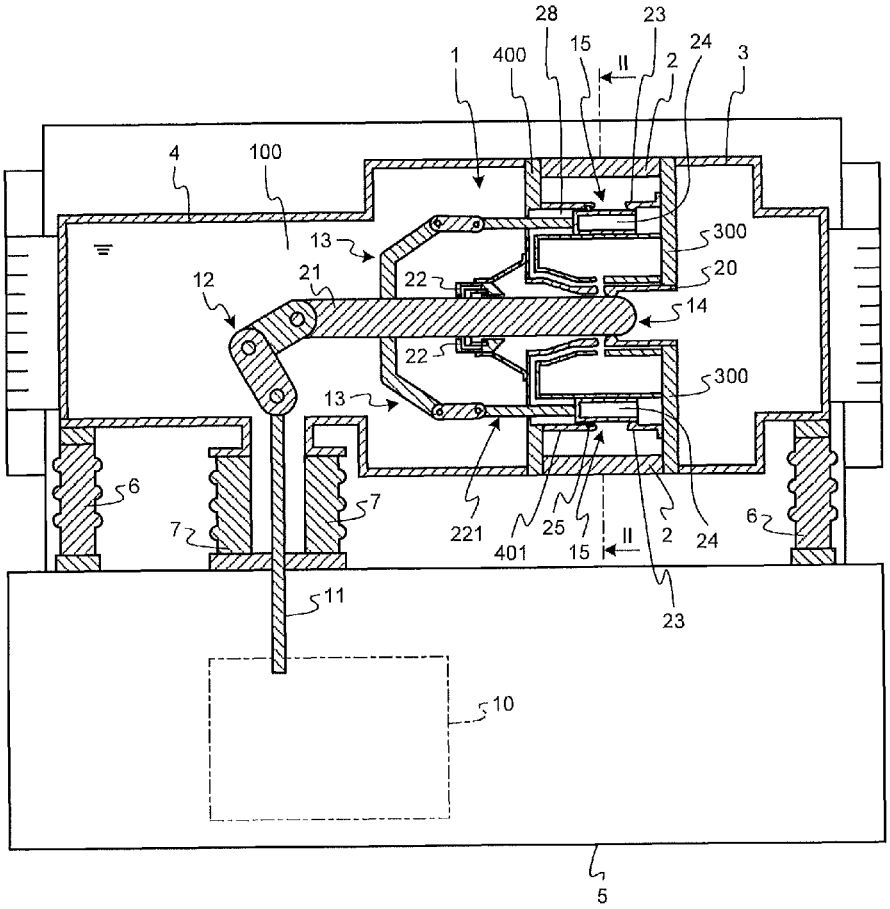
FIG. 1 is a cross-sectional view showing a current conducting state of a gas circuit breaker according to a first embodiment of the present invention.
Figure 2:
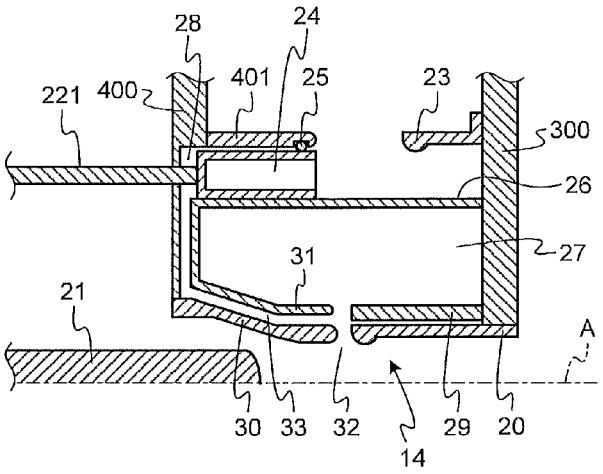
FIG. 2 is a partial enlarged cross-sectional view showing a partial configuration of a current cutoff unit and a current conduction unit in a current cutoff state.

FIG. 1 is a cross-sectional view of a current conducting state of a gas circuit breaker according to a first embodiment of the present invention. FIG. 2 is a partial enlarged cross-sectional view of a partial configuration of a current cutoff unit and a current conduction unit in a current cutoff state. In FIGS. 1 and 2, a switching unit 1 for conducting or cutting off a current is accommodated in a hermetically sealed tank 100 that is integrally constituted by an insulating cylinder 2 formed of, for example, epoxy resin, a fixed-side cylindrical conductor 3 having a cylindrical container shape, which is linked to one end of the insulating cylinder 2, and a movable-side cylindrical conductor 4 having a cylindrical container shape, which is linked to the other end of the insulating cylinder 2.

Inside the sealed tank 100 is filled with insulation gas such as sulfur hexafluoride (SF6), and the sealed tank 100 is installed on a support mount 5 with being supported by a support insulating member 6 and a support insulating member 7. An operation unit 10 is installed on the support mount 5, by which a switching operation of the switching unit 1 is performed via an insulating operation rod 11 that is formed of an insulating member, a link mechanism 12 and a link mechanism 13.

The support insulating member 6 supports around an end portion of the sealed tank 100 installed with its axis lying in a horizontal direction, in an insulating manner. Furthermore, a side surface of the movable-side cylindrical conductor 4 has a hole through which the insulating operation rod 11 penetrates, with one end of the rod being connected to the link mechanism 12 provided inside the sealed tank 100 and the other end thereof being connected to the operation unit 10 provided outside the sealed tank 100, and the support insulating member 7 supports around the hole of the movable-side cylindrical conductor 4 in an insulating manner.

The switching unit 1 is configured to include a current cutoff unit 14 that cuts off a current and a current conduction unit 15 that conducts a rated current. The current cutoff unit 14 includes a fixed-side auxiliary conductor 300 that is connected to the fixed-side cylindrical conductor 3, a fixed arc contact 20 that is electrically connected to the fixed-side auxiliary conductor 300, and a movable arc contact 21 facing the fixed arc contact 20 on the same axial line.

The movable arc contact 21 is connectable and disconnectable with the fixed arc contact 20 on the axial line, and electrically connected with a movable-side auxiliary conductor 400 that is connected to the movable-side cylindrical conductor 4 via a rod contact 22.

An end portion of the movable arc contact 21 on the opposite side of the fixed arc contact 20 is connected to the link mechanism 12, and the movable arc contact 21 can make linear back-and-forth movement in an axial line direction in compliance with the operation unit 10 via the link mechanism 12 and the insulating operation rod 11.

The link mechanism 13 is connected to the movable arc contact 21, and in conjunction with an operation of the movable arc contact 21 via the link mechanism 13, a movable conducting contact described later is configured to move back and forth in the axial line direction. In the following explanations, an area where an arc is generated when the fixed arc contact 20 and the movable arc contact 21 are opened is referred to as "arc generation area 32".

Figure 3:
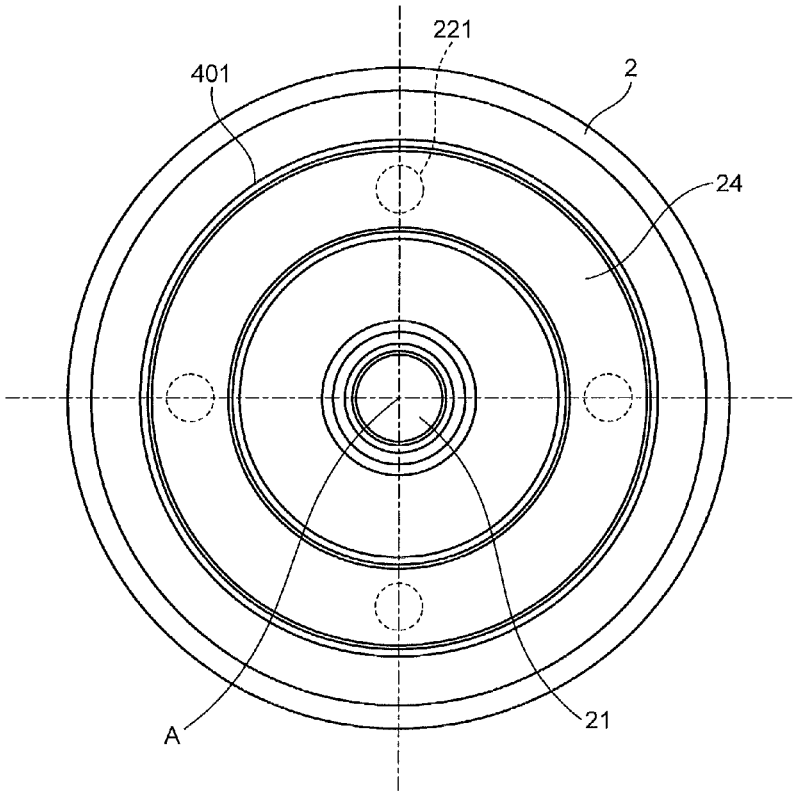
FIG. 3 is an enlarged cross-sectional view taken along lines II-II shown in FIG. 1, and is a cross-sectional view as viewed in a direction of arrows given to the lines II-II.

FIG. 3 is an enlarged cross-sectional view taken along lines II-II shown in FIG. 1, and is a cross-sectional view as viewed in a direction of arrows given to the lines II-II. As shown in FIG. 3, the current conduction unit 15 is constructed of a fixed conducting contact 23 that is electrically connected to the fixed-side auxiliary conductor 300 and a movable conducting contact (piston) 24 having a toric shape facing the fixed conducting contact 23.

The movable conducting contact 24 can be connected and disconnected with the fixed conducting contact 23. An end portion of the movable conducting contact 24 on a side of the fixed conducting contact 23 is in an open state, and this open end portion is fitted in the fixed conducting contact 23 to establish a contact state. A piston rod 221 connected to the link mechanism 13 is fixed to the movable conducting contact 24 having a toric shape. With this configuration, according to back-and-forth movement of the movable arc contact 21, the piston rod 221 moves back and forth in the same direction, and the movable conducting contact 24 connected to the piston rod 221 also moves back and forth. By the movable conducting contact 24 moving back and forth, the conducting contacts are connected or disconnected with each other.

A movable-side conductor 401 is connected to the movable-side auxiliary conductor 400. The movable conducting contact 24 is connected with the movable-side conductor 401 in a slidable manner while being electrically contacting the movable-side conductor 401 via a ring-shaped contact 25. A thermal puffer chamber 27 formed by a partition wall 26, a part of which is an insulating material, is provided on the inner diameter side of the toric movable conducting contact 24. The inner diameter side of the movable conducting contact 24 makes contact with the partition wall 26 in a slidable manner.

An area surrounded by the movable-side auxiliary conductor 400, the movable-side conductor 401, the movable conducting contact 24, and the partition wall 26 constitutes a mechanical puffer chamber (cylinder) 28 that accommodates therein the movable conducting contact 24. As shown in FIG. 3, the mechanical puffer chamber 28 is formed in a toric shape centering around an axial line A of the movable arc contact 21.

The movable conducting contact 24 is configured to move back and forth according to the movement of the movable arc contact 21 in the mechanical puffer chamber 28. The mechanical puffer chamber 28 has its volume to contain, that is changed with open and close operations of the movable conducting contact 24 and the fixed conducting contact 23, that is, movement of the movable conducting contact 24. More specifically, the volume of the mechanical puffer chamber 28 is decreased with an opening operation of the movable conducting contact 24 and the fixed conducting contact 23.

A member 29 connected to the fixed-side auxiliary conductor 300 is arranged along an outer circumference of the fixed arc contact 20. An insulating nozzle 30 connected to the movable-side auxiliary conductor 400 is extended toward the fixed side. An insulating member 31 is arranged along an outer circumference of the insulating nozzle 30, thereby forming the thermal puffer chamber 27.

The thermal puffer chamber 27 is formed in a toric shape so as to surround the arc generation area 32 centering around the axial line A.

Tips of the member 29 and the insulating member 31 are separated from each other by a predetermined gap, and this gap forms an opening of the thermal puffer chamber 27. This opening connects the thermal puffer chamber 27 and the arc generation area 32. That is, the opening of the thermal puffer chamber 27 is provided in an inner circumferential face of the thermal puffer chamber 27 along a circumferential direction thereof. This opening may be a single opening formed across the whole in the circumferential direction or may be a plurality of openings formed along the circumferential direction.

The mechanical puffer chamber 28 is connected to the arc generation area 32 via a discharge flow path 33 formed by the insulating nozzle 30 and the insulating member 31. That is, the discharge flow path 33 connects the mechanical puffer chamber 28 and the arc generation area 32 without involving the thermal puffer chamber 27.

An operation of the gas circuit breaker according to the present embodiment is described next. In the gas circuit breaker configured as described above, the movable arc contact 21 of the current cutoff unit 14 is operated in the axial line direction by the operation unit 10 via the insulating operation rod 11 and the link mechanism 12. With this operation, the open and close operations of the movable arc contact 21 with respect to the fixed arc contact 20 is performed.

In conjunction with the open and close operations of the movable arc contact 21, the movable conducting contact 24 of the current conduction unit 15 is operated in the axial line direction via the link mechanism 13. With this operation, the open and close operations of the movable conducting contact 24 with respect to the fixed conducting contact 23 is performed.

A current cutoff operation of the gas circuit breaker according to the present embodiment, which is configured as described above, is described next. First, the movable conducting contact 24 is opened and away from the fixed conducting contact 23, and thereafter the movable arc contact 21 is opened and away from the fixed arc contact 20. With this opening operation, an arc is generated in the arc generation area 32 between the movable arc contact 21 and the fixed arc contact 20.

As for current cutoff in a large-current area, insulation gas in the arc generation area 32 is heated and pressurized by arc energy and accumulated in the thermal puffer chamber 27. Thereafter, the heating and pressurizing in the arc generation area 32 is decreased as the current approaches a zero point, and then high-pressure insulation gas accumulated in the thermal puffer chamber 27 is discharged to the arc in the arc generation area 32, so that the arc is extinguished, by which the current cutoff is performed.

The volume of the mechanical puffer chamber 28 is decreased with the opening operation of the movable conducting contact 24. At this time, the insulation gas in the mechanical puffer chamber 28 is compressed, and cool insulation gas is discharged and applied to the arc generation area 32 through the discharge flow path 33, by which insulation performance is recovered.

As for current cutoff in medium-current and small-current areas, because the insulation gas in the arc generation area 32 is insufficiently heated, the pressure of the thermal puffer chamber 27 is not increased so much. On the other hand, regardless of whether heating of the insulation gas is performed, the insulation gas is compressed in the mechanical puffer chamber 28 with the opening operation of the movable conducting contact 24. Therefore, by the insulation gas being discharged and applied to the arc generation area 32, the arc is extinguished so that the current cutoff is performed and insulation performance is recovered.

At the time of conducting a current (power on), the movable arc contact 21 and the fixed arc contact 20 are connected to each other, and then the movable conducting contact 24 and the fixed conducting contact 23 are connected to each other, by which the current is conducted therethrough.

As described above, according to the present embodiment, because the thermal puffer chamber 27 is provided surrounding the arc contacts 20 and 21, and the mechanical puffer chamber 28 is formed in a toric shape centering around the axial line A, this configuration can contribute to shortening of the length of the gas circuit breaker in the axial direction. Furthermore, the efficiency of arranging the mechanical puffer chamber 28 and the thermal puffer chamber 27 with respect to the circumferential direction of the gas circuit breaker can be improved. Accordingly, downsizing of the gas circuit breaker can be achieved.

Figure 4:
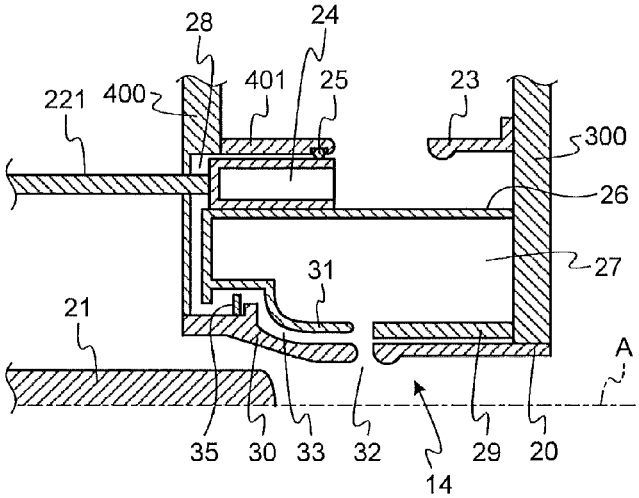
FIG. 4 is a partial cross-sectional view showing a partial configuration of a current cutoff unit and a current conduction unit of a gas circuit breaker according to a modification of the first embodiment, in which a current cutoff state is shown.

FIG. 4 is a partial cross-sectional view of a partial configuration of a current cutoff unit and a current conduction unit of a gas circuit breaker according to a modification of the first embodiment, in which a current cutoff state is shown. In this modification, a check valve 35 is provided in the discharge flow path 33. The check valve 35 prevents a flow of insulation gas from the arc generation area 32 to the mechanical puffer chamber 28, and at the same time, enables a flow of the insulation gas from the mechanical puffer chamber 28 to the arc generation area 32 when the pressure of the mechanical puffer chamber 28 is higher than the pressure of the arc generation area 32.

By providing the check valve 35, it is possible to suppress application of an excessive pressure to the mechanical puffer chamber 28 due to the increase of the pressure of the arc generation area 32, and therefore operation power of the operation unit 10 can be set lower, which can contribute to downsizing of the gas circuit breaker.

Second Embodiment

Figure 5:
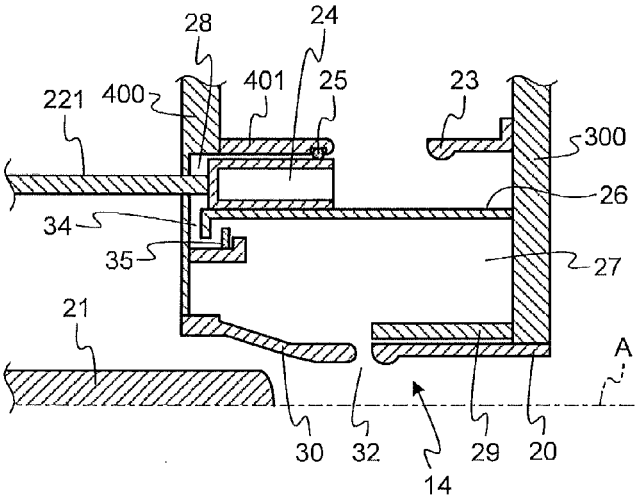
FIG. 5 is a partial cross-sectional view of a partial configuration of a current cutoff unit and a current conduction unit of a gas circuit breaker according to a second embodiment of the present invention, in which a current cutoff state is shown.

FIG. 5 is a partial cross-sectional view of a partial configuration of a current cutoff unit and a current conduction unit of a gas circuit breaker according to a second embodiment of the present invention, in which a current cutoff state is shown. Constituent elements identical to those of the first embodiment described above are denoted by like reference signs and explanations thereof will be omitted. In addition, configurations not shown in FIG. 5 are identical to, for example, configurations of the first embodiment shown in FIG. 1.

In the present embodiment, the thermal puffer chamber 27 and the mechanical puffer chamber 28 are connected to each other via a connecting hole 34 provided between the movable-side auxiliary conductor 400 and the partition wall 26. Furthermore, the check valve (back-flow prevention unit) 35 that prevents a flow of the insulation gas from the thermal puffer chamber 27 to the mechanical puffer chamber 28 is provided in the connecting hole 34 on a side of the thermal puffer chamber 27.

A current cutoff operation of the gas circuit breaker according to the present embodiment configured in the above manner is described next.

As for current cutoff in a large-current area, insulation gas in the arc generation area 32 is heated and pressurized by arc energy and accumulated in the thermal puffer chamber 27. When the pressure of the thermal puffer chamber 27 exceeds the pressure of the mechanical puffer chamber 28, the check valve 35 operates to close the connection hole 34.

Thereafter, the heating and pressurizing in the arc generation area 32 is decreased as the current approaches a zero point, and then the high-pressure insulation gas accumulated in the thermal puffer chamber 27 is discharged and applied to the arc in the arc generation area 32 so that the arc is extinguished, by which the current cutoff is performed.

With this operation, the pressure of the thermal puffer chamber 27 is decreased, and at the same time, the volume of the mechanical puffer chamber 28 is decreased with the opening operation of the movable conducting contact 24 so that the insulation gas is compressed. Therefore, the pressure of the mechanical puffer chamber 28 becomes relatively higher, and the check valve 35 is opened. With this valve opening operation, the cool insulation gas compressed in the mechanical puffer chamber 28 is discharged and applied to the arc generation area 32 through the thermal puffer chamber 27, by which insulation performance is recovered.

As for current cutoff in medium-current and small-current areas, because the insulation gas in the arc generation area 32 is heated insufficiently, the pressure of the thermal puffer chamber 27 is not increased so much. Therefore, the check valve 35 of the connection hole 34 is maintained in an open state. Thereafter, insulation gas compressed in the mechanical puffer chamber 28 is discharged and applied to the arc generation area 32 through the thermal puffer chamber 27, so that the arc is extinguished and current cutoff is achieved, and the insulation performance is recovered.

According to the present embodiment, the mechanical puffer chamber 28 is connected to the arc generation area 32 via the thermal puffer chamber 27, and therefore formation of a separate flow path communication with the arc generation area can be omitted, by which simplification of the configuration of the gas circuit breaker can be realized.

Furthermore, by providing the check valve 35, it is possible to suppress application of an excessive pressure to the mechanical puffer chamber 28 due to the increase of the pressure of the thermal puffer chamber 27, and therefore operation power of the operation unit 10 can be set lower, which can contribute to downsizing of the gas circuit breaker.

INDUSTRIAL APPLICABILITY

As described above, the gas circuit breaker according to the present invention is useful as a gas circuit breaker including a thermal puffer chamber and a mechanical puffer chamber.

REFERENCE SIGNS LIST

1 switching unit
2 insulating cylinder
3 fixed-side cylindrical conductor
4 movable-side cylindrical conductor
5 support mount
6, 7 support insulating member
10 operation unit
11 insulating operation rod
12, 13 link mechanism
14 current cutoff unit
15 current conduction unit
20 fixed arc contact
21 movable arc contact
22 rod contact
23 fixed conducting contact
24 movable conducting contact (piston)
25 contact
26 partition wall
27 thermal puffer chamber
28 mechanical puffer chamber (cylinder)
29 member
30 insulating nozzle
31 insulating member
32 arc generation area
33 discharge flow path
34 connecting hole
35 check valve
100 sealed tank
221 piston rod
300 fixed-side auxiliary conductor
400 movable-side auxiliary conductor
401 movable-side conductor
A axial line A

The invention claimed is:

1. A gas circuit breaker comprising:

a sealed tank filled with insulation gas;

a pair of arc contacts that are arranged to face each other in the sealed tank and connectable and disconnectable with each other;

a thermal puffer chamber that is provided on an outer circumferential portion of the pair of arc contacts, a part of which is formed by a partition wall;

a mechanical puffer chamber that is provided on an outer circumference of the thermal puffer chamber and constituted by a cylinder formed in a toric shape centering around an axial line of the arc contacts; and a piston that is formed in a toric shape centering around the axial line and accommodated in the cylinder whose part is formed by the partition wall, and configured to move according to connection and disconnection of the arc contacts, wherein the thermal puffer chamber is formed in a toric shape so as to surround an arc generation area centering around the axial line of the arc contacts, and includes an opening along a circumferential direction on an inner circumferential surface of the thermal puffer chamber, the piston is a movable conducting contact that makes a conducting state when in contact with a fixed conducting contact, and the partition wall has at least its part being formed of an insulating material.

2. The gas circuit breaker according to claim 1, wherein the mechanical puffer chamber is connected to an arc generation area via the thermal puffer chamber.

3. The gas circuit breaker according to claim 2, further comprising a back-flow prevention unit that prevents a flow of insulation gas from the thermal puffer chamber to the mechanical puffer chamber, and enables a flow of the insulation gas from the mechanical puffer chamber to the thermal puffer chamber when a pressure of the mechanical puffer chamber is higher than a pressure of the thermal puffer chamber.

4. The gas circuit breaker according to claim 1, further comprising a discharge flow path that connects the mechanical puffer chamber to an arc generation area without involving the thermal puffer chamber.

5. The gas circuit breaker according to claim 4, further comprising a back-flow prevention unit that is provided in the discharge flow path, prevents a flow of insulation gas from the arc generation area to the mechanical puffer chamber, and enables a flow of the insulation gas from the mechanical puffer chamber to the arc generation area when a pressure of the mechanical puffer chamber is higher than a pressure of the arc generation area.

* * * * *